US008402588B2

(12) United States Patent
Harris et al.

(10) Patent No.: US 8,402,588 B2
(45) Date of Patent: Mar. 26, 2013

(54) MULTI-LAYER SURFACE TREATMENT PAD FOR MOTORIZED DEVICE

(71) Applicants: Jennifer R. Harris, Shorewood, WI (US); Ann Marie Przepasniak, Sturtevant, WI (US); Jeremy F. Knopow, Burlington, WI (US)

(72) Inventors: Jennifer R. Harris, Shorewood, WI (US); Ann Marie Przepasniak, Sturtevant, WI (US); Jeremy F. Knopow, Burlington, WI (US)

(73) Assignee: S.C. Johnson & Son, Inc., Racine, WI (US)

( * ) Notice: Subject to any disclaimer, the term of this patent is extended or adjusted under 35 U.S.C. 154(b) by 0 days.

(21) Appl. No.: 13/630,250

(22) Filed: Sep. 28, 2012

(65) Prior Publication Data

US 2013/0040540 A1 Feb. 14, 2013

Related U.S. Application Data

(62) Division of application No. 12/542,880, filed on Aug. 18, 2009, now Pat. No. 8,302,243.

(51) Int. Cl.
*A47L 11/162* (2006.01)
*A47L 11/164* (2006.01)

(52) U.S. Cl. ..... 15/97.1; 15/98; 15/104.94; 451/359; 451/539

(58) Field of Classification Search ..... 15/97.1, 15/98, 104.93, 104.94; 451/359, 539
See application file for complete search history.

(56) References Cited

U.S. PATENT DOCUMENTS

| | | | |
|---|---|---|---|
| 2,820,977 | A | 1/1958 | Carr |
| 3,008,168 | A | 11/1961 | Doyle |
| 3,284,963 | A | 11/1966 | Lanham et al. |
| 3,635,567 | A | 1/1972 | Richardson, Jr. |
| 4,515,703 | A | 5/1985 | Haq |
| 4,963,045 | A | 10/1990 | Willcox |
| 5,979,003 | A | 11/1999 | Billat |
| 6,101,661 | A | 8/2000 | Policicchio et al. |
| 6,491,928 | B1 | 12/2002 | Smith, III |
| 6,979,371 | B1 | 12/2005 | Policicchio et al. |
| 7,138,560 | B2 | 11/2006 | Przepasniak et al. |
| 7,228,586 | B2 | 6/2007 | Prodoehl et al. |
| 7,523,821 | B2 | 4/2009 | Assie et al. |
| 2004/0103490 | A1 | 6/2004 | Long et al. |
| 2006/0048319 | A1 | 3/2006 | Morgan et al. |
| 2008/0060741 | A1 | 3/2008 | Privitera et al. |
| 2008/0166176 | A1 | 7/2008 | Rees et al. |

FOREIGN PATENT DOCUMENTS

| | | |
|---|---|---|
| EP | 1477098 | 11/2004 |
| GB | 1532457 | 11/1978 |
| WO | WO2004/108036 | 12/2004 |
| WO | WO2008/103803 | 8/2008 |

OTHER PUBLICATIONS

An advertisement from Sonicscrubbers showing their oscillating driver as used with a scrubbing pad, dated Jul. 2009.
Four pages of a PCT search report dated Dec. 15, 2010 for PCT/US2010/002240, a family member.

*Primary Examiner* — Randall Chin

(57) ABSTRACT

A multi-layer surface treating pad is disclosed. It has an upper layer suitable to serve as one part of a hook/loop type fastener system, a bottom layer which comprises an abrasive or polishing material, and a cleaning or other surface treating formulation positioned between the upper and bottom layer in the form of a bump which is positioned mostly in a central region of the pad. The bump of the formulation causes the upper layer to bulge upwardly so as to provide a visual indication as to where one optimally should attach a motorized device thereto.

7 Claims, 4 Drawing Sheets

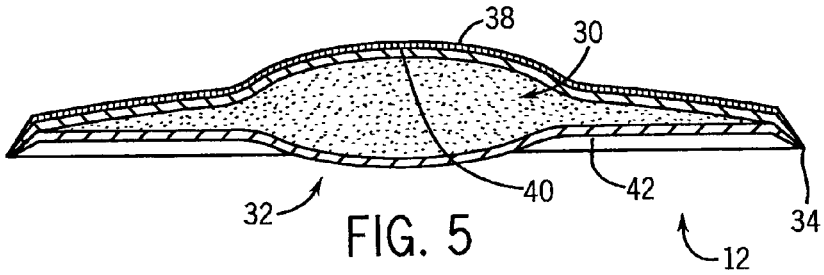
FIG. 5
FIG. 6
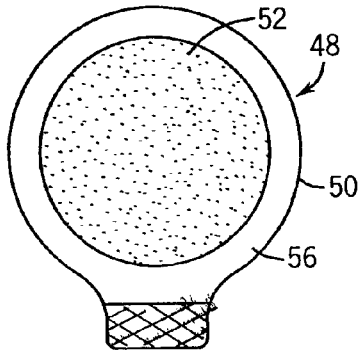
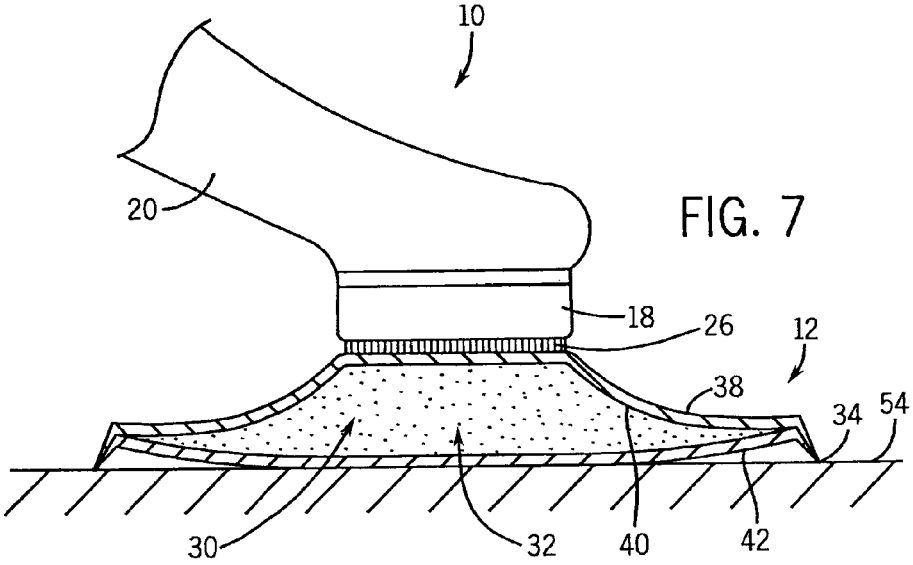
FIG. 7

MULTI-LAYER SURFACE TREATMENT PAD FOR MOTORIZED DEVICE

CROSS-REFERENCE TO RELATED APPLICATIONS

This application claims priority based on U.S. Ser. No. 12/542,880 filed on Aug. 18, 2009, now allowed as U.S. Pat. No. 8,302,243.

STATEMENT REGARDING FEDERALLY SPONSORED RESEARCH/DEVELOPMENT

Not applicable.

BACKGROUND OF THE INVENTION

The present invention relates to surface treating pads for attachment to a motorized driver device.

To clean a dirty surface it is common to use a chemical cleaning formulation with wiping or brushing to loosen and remove debris, dirt, and the like from the surface. Similarly, to work in a polish or wax on furniture or a floor one often rubs it in with a rag or the like.

Motorized force can more easily clean or polish a surface, or otherwise treat it. Some prior art devices have abrasive wheels or polishers that are motor driven. For example, SonicScrubbers markets a replaceable abrasive pad mountable on a rotary oscillating driver to facilitate the pad cleaning hard surfaces (such as those typically found in the home).

However, these motorized approaches typically required separate manual application of a cleaning or other treating formulation to the wall or other surface being treated. Further, they can sometimes result in uncontrolled splattering of fluid (e.g. if the pad is overwetted). Moreover, special care had to be taken, at increased cost, to keep such pads from delaminating prematurely.

It has been proposed that a pad mountable on an oscillating driver be impregnated with cleaner (or have a pocket where a cleaner packet could be inserted) so that the device also delivered a cleaner to the surface. However, this still left some of the other concerns noted above.

Thus, a need still exists for improved surface treating pads that are used with a motorized driver device.

BRIEF SUMMARY OF THE INVENTION

The invention provides in one aspect a multi-layer surface treating pad. It has an upper layer suitable to serve as one part of a fastener system (preferably a hook/loop type fastener system), a bottom layer which comprises a first (preferably abrasive or polishing) material, and a surface treating formulation (preferably a cleaning formulation) positioned between the upper layer and the bottom layer in the form of a bump (e.g. a plateau, dome or the like) which is positioned mostly, by volume occupied, in a central region of the pad. The bump of surface treating formulation causes the upper layer to bulge upwardly so as to provide a visual indication as to where one might attach a motorized device thereto.

There can be an interior layer positioned between the upper and bottom layer, the interior layer being made of an absorbent material. While a variety of layer materials are possible, in one form the upper layer comprises a laminated substrate of N35 loop polyester with a 20 micro polypropylene film backing adhesively bonded with a hot melt moisture-cured adhesive, the interior layer comprising a blend of cellulose and synthetic binder fibers, and the bottom layer comprises polyester.

Most preferably the upper, interior, and bottom layers are welded together, such as with an array of spokes or spot welds radiating outwardly from the central region of the pad, radially outward from the bump, and with a circumferential peripheral weld. The pad is preferably a generally circular disk in top view, but may include one or more small tab(s) projecting radially outward there from to facilitate gripping without exposing the user to the formulation. The welds may also be in other configurations, such as a line of spot welds, or rings of welds.

In another form of the present invention an outer circumferential edge of the pad is biased downwardly relative to a more central portion of the pad as a skirt. This creates a cup-shaped contact area so that liquid is inhibited from spraying radially outward during use.

For ease of manufacture the formulation can be applied in the form of a flowable material such as a paste or gel. Alternatively, it could be an encapsulated solid particulate or other easily applied solid material. If a cleaner the formulation will typically contain a surfactant, but may also have other ingredients such as an acid (e.g. lactic acid), a glycol ether solvent, and a fragrance. If a polish or other surface treating material, it will contain ingredients more suitable for such purposes (e.g. silicones).

In another form the invention provides a cleaning device which has a motorized driver having a head that rotates (e.g. continuous rotation in one direction, or oscillatory rotation back and forth). The head has a face presenting a part of a fastening system (preferably a hook/loop type fastening system). Examples of this type of device are the SonicScrubbers Model SSB, SSK, and SSD4 drivers.

In accordance with the present invention it is proposed to use that type of device with an improved multi-layer surface treating pad. The pad has an upper layer suitable to serve as another part of the fastener system so as to be mountable against said face and rotated thereby, a bottom layer which comprises (preferably) an abrasive, polishing or other surface treating material, and a surface treating formulation that is positioned between the upper and bottom layer before the pad is used.

Pads of the present invention use the driving power of a motorized device to apply surface treating formulations, without the need to separately add the formulation at the time of use. The pads are designed to minimize radial spraying caused by the pad being driven when wet, to provide a visual indication of the appropriate attachment point for the driver against the pad, and to provide an attachment point where pressing the driver against the pad also facilitates enhanced release of the chemicals. These pads can be produced at very low cost, and the weld patterns help them avoid premature separation.

The foregoing and other advantages of the present invention will be apparent from the following description. In that description reference is made to the accompanying drawings which form a part thereof, and in which there is shown by way of illustration, and not limitation, preferred embodiments of the invention. Such embodiments do not necessarily represent the full scope of the invention, and reference should therefore be made to the claims herein for interpreting the scope of the invention.

BRIEF DESCRIPTION OF THE DRAWINGS

FIG. 2 is an exploded perspective view of the motorized device with a pad being removed there from;

FIG. 5 is a cross-sectional side view taken along line 5-5 of FIG. 3;

FIG. 6 is a top view of a second pad, one having a smaller abrasive scrubbing area; and FIG. 7 is a environmental view, partially in section, of the pad of FIG. 3 attached to a head of the motorized device, in which the pad is cleaning a counter top surface.

DETAILED DESCRIPTION OF THE PREFERRED EMBODIMENTS

Figure 1:
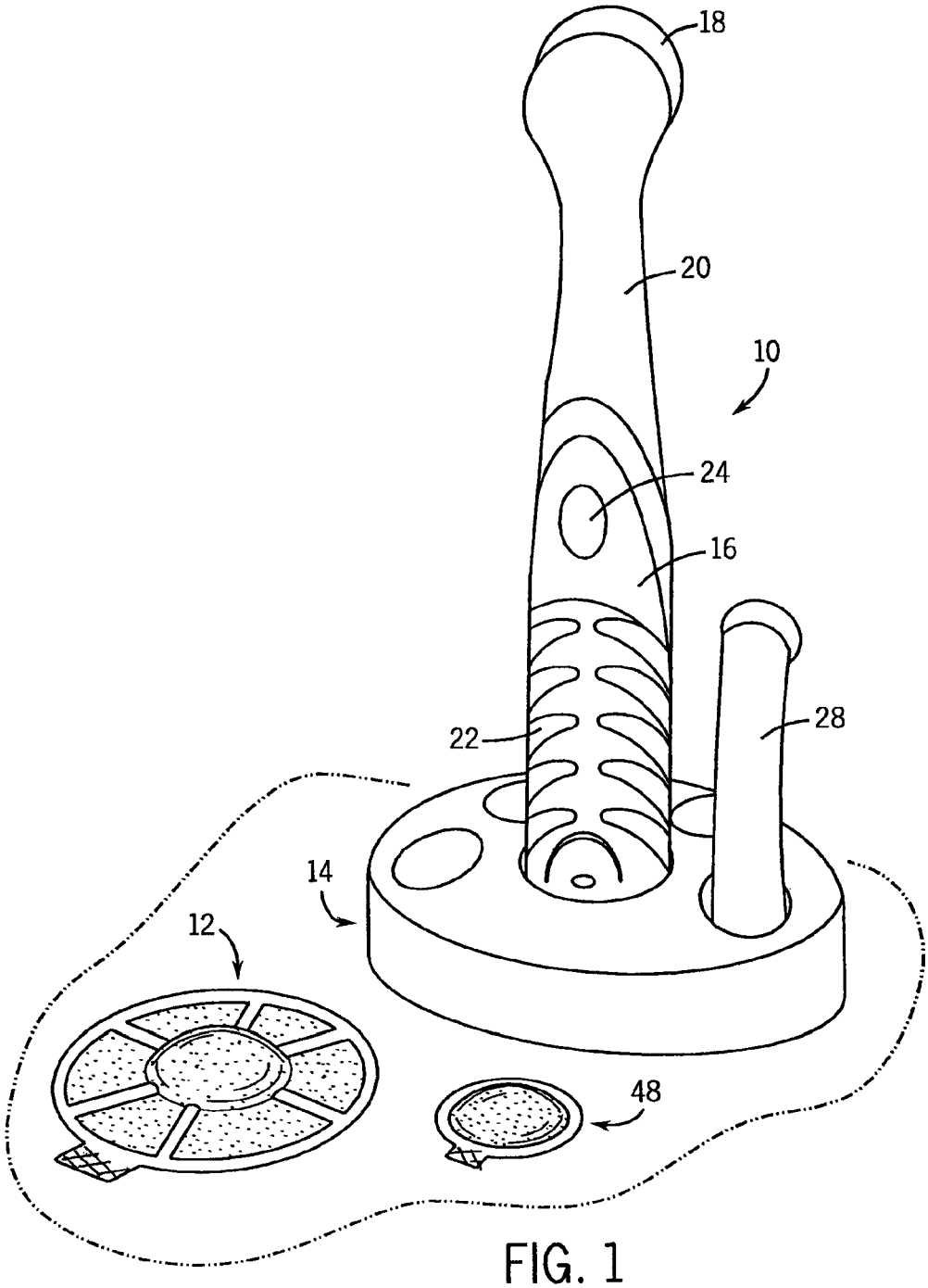
FIG. 1 is an environmental view of a motorized device of the present invention in a storage tray, with two types of replacement pads shown nearby.
Figure 2:
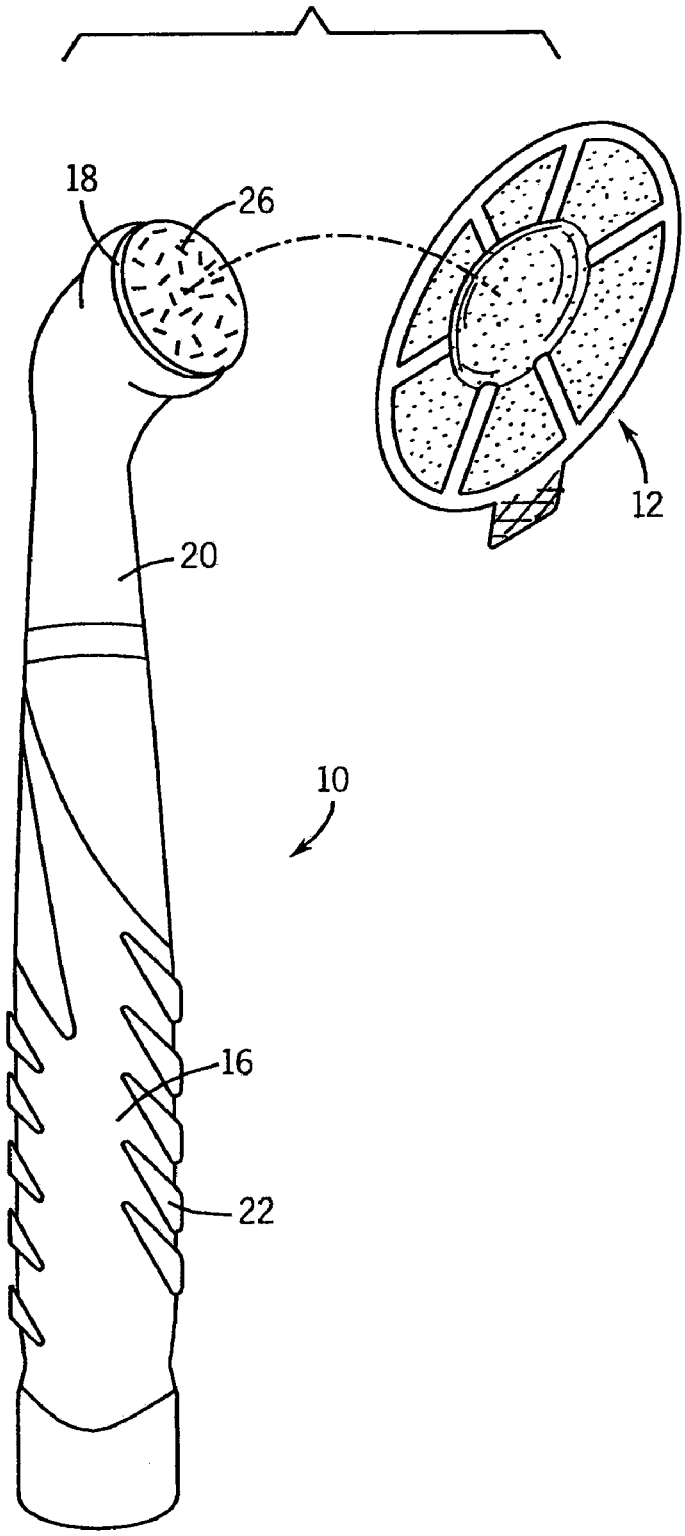

Referring first to FIGS. 1 and 2, a motorized device 10 is shown adjacent a first cleaning pad 12. The motorized device 10 may be held in a storage tray 14 when the motorized device 10 is not in use. The motorized device 10 is shown removed from the storage tray 14 in FIG. 2.

The motorized device 10 has a handle 16 and a head 18 at the end of a first neck 20. The handle 16 includes a gripping portion 22 with an overmolded patterned rubber surface to improve the grip of a user holding the motorized device 10. Above the handle 16, in the direction of the neck 20, an on/off button 24 is located in a convenient location for manipulation by a thumb of a user holding the gripping portion 22.

The on/off button 24 may be toggled to start or stop the operation of an internal motor (not shown) in the motorized device 10 which drives the rotary oscillation of the head 18. Although not shown, the handle 16 receives batteries in its base which supply the energy necessary for power to the internal motor. Rechargeable batteries, removable or permanent, may also be used to power the internal motor, or a power cord may be used. The internal motor has a drive shaft which is rotated and this rotary motion is transferred into a shaft in the neck 20. A scotch yoke-type mechanism or the like in the neck 20 turns this full rotary motion into an oscillating rotary motion in an attachment surface 26 of the head 18.

A first cleaning pad 12 may be attached to the attachment surface 26 of the head 18 using a hook/loop type fastening system. One half of the hook/loop type fastening system is located on the attachment surface 26, while the other half of the hook/loop type fastening system is located on at least a central upper region of the cleaning pad 12 along a bump as will be described in more detail below. When the cleaning pad 12 is attached to the attachment surface 26 of the head 18 and the motorized device 10 is turned on, the oscillating rotary motion of the head 18 is transmitted into the cleaning pad 12 to provide a scrubbing motion.

The neck 20 is detachable and may be replaced by a smaller alternative neck 28 (shown in the storage tray 14 in FIG. 1) or other attachments. In the form shown, the neck 20 may be removed by twisting the neck 20 and axially separating the neck 20 from the handle 16. The alternative neck 28 may be then attached by axially pushing the alternative neck 28 onto the handle 16 and twisting the two components relative to one another to lock them together. Although a two-piece motorized device 10 preferably has a bayonet-type connection, it should be appreciated that other types of attachment could also be used, or that the motorized device 10 may not have interchangeable components apart from the pads.

In the form shown, the main difference between neck 20 and alternative neck 28 is that neck 20 has a larger attachment surface 26 than the alternative neck 28. Accordingly, the neck 20 is better suited to be attached to a larger cleaning pad 12 than the alternative neck 28.

Figure 3:
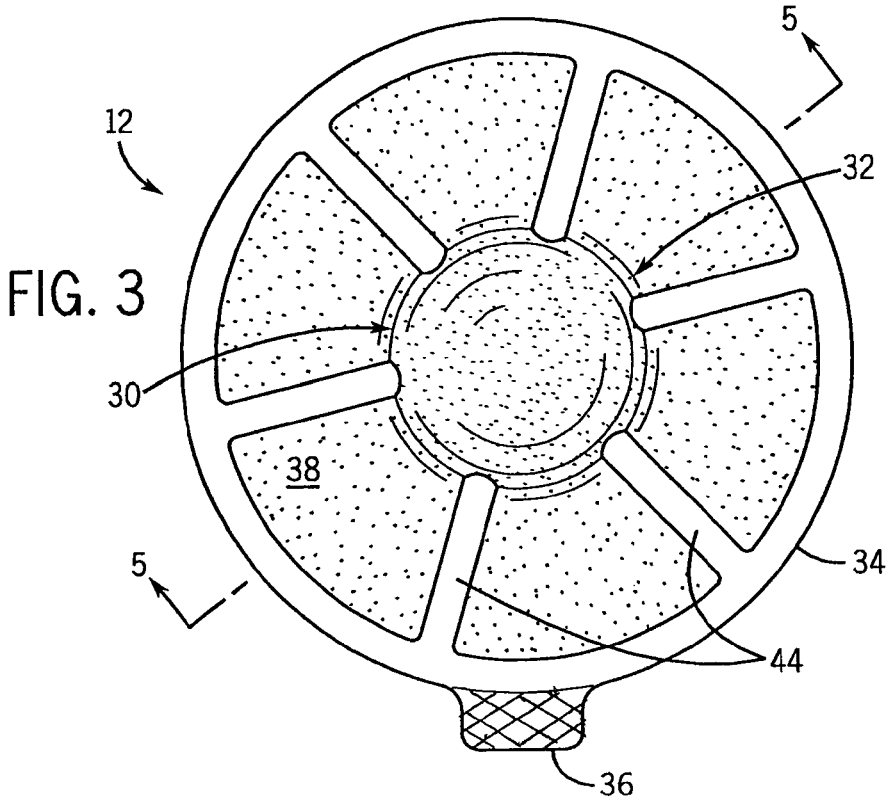
FIG. 3 is a top view of a first pad, one having a large bottom abrasive scrubbing area.
Figure 4:
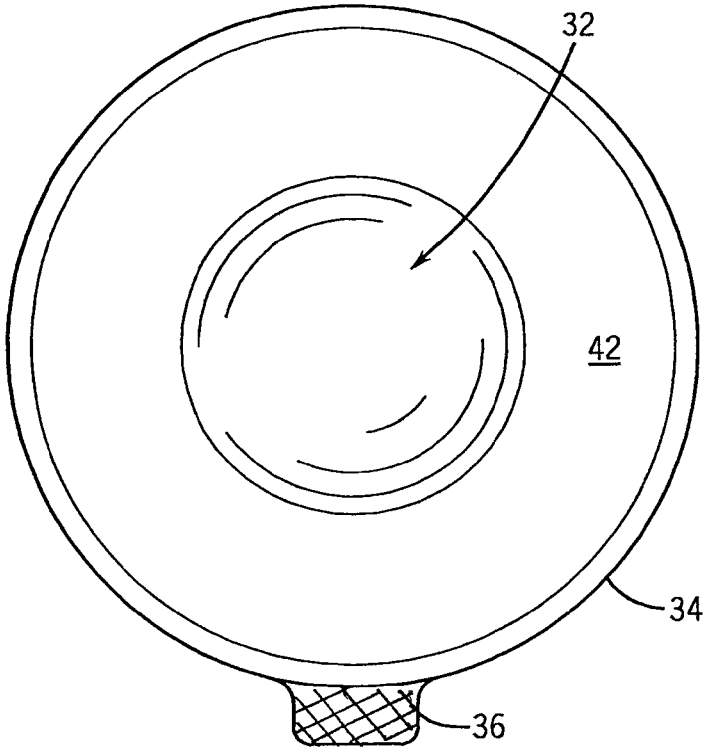
FIG. 4 is a bottom view the pad of FIG. 3.

Referring now to FIGS. 3-5, the cleaning pad 12 is in the shape of a generally circular disk and includes a bump 30 in a mostly central region 32 of the pad 12 and an outer circumferential edge 34. The bump can be essentially circular in top view, or have other top view shapes. About the pad's outer circumferential edge 34, a tab 36 extends radially there from such that the pad 12 can be handled without coming into direct contact with a cleaning fluid or the like that is contained in the center of the pad 12. The tab 36 may have coloration that indicates a particular type of cleaning composition is contained in the pad or the intended area of use in the home (e.g., a green tab is a pad with a chemical formulation for use in a kitchen, a blue tab is a pad for use in the bathroom and represents a bleaching formulation, and so forth).

As best seen in FIG. 5, the cleaning pad 12 comprises three layers including an upper layer 38, an interior layer 40, and a bottom layer 42. The upper layer 38 is suitable to serve as one of the parts of the hook/loop type fastener system and includes a laminated substrate of N35 loop polyester available from Aplix with a 20 micro polypropylene film backing adhesively bonded with (for example) polyurethane hot melt moisture-cured adhesive available from Nordson. The interior layer 40 is an absorbent layer comprising a blend of cellulose and synthetic binder fiber available from Ahlstrom. The bottom layer 42 is an abrasive layer made of polyester available from Matador. It should be appreciated that the exact nature of the layers can be varied, except that it is particularly preferred to have the upper layer facilitate attachment to the driver. Also, for a cleaning application making the lower layer abrasive is highly preferred.

At selected locations, the upper layer 38 and the bottom layer 42 are welded together. As best seen in FIG. 3, the layers are welded about the outer circumferential edge 34 of the cleaning pad 12 as well as along radial weld lines 44, which form an array of spokes that extend radially outward from the central region 32 of the cleaning pad 12 (i.e., radially outwardly from the bump 30). Further, the welded portion of the outer circumferential edge 34 is downwardly biased by a molding step relative to the more central portion of the pad 12, as is best seen in FIGS. 5 and 7, to provide a skirt around the outer circumferential edge 34 of the area being cleaned when the pad 12 is in use. The edge of the skirt can be thicker at its outer edge than shown if desired.

While weld lines 44 are visible in the FIG. 3 top view, in one form they do not extend all the way to the bottom of the structure (as shown in FIG. 4). However, alternatively they could be made to also project to the bottom of the pad.

A flowable cleaning formulation (e.g. a flowable paste) is initially (i.e., before the pad 12 is used for cleaning) positioned between the interior layer 40 and the bottom layer 42. The three layer sandwich formed thereby is then placed in a press mold having central recesses at the top and bottom. Closing the press mold causes the paste to distort central regions of the upper and lower layers into the recesses, thereby forming a visible bump 30 region on the pad.

The cleaning formulation is thereby located mostly in the area of the bump 30, such that when the attachment surface 26 of the head 18 is attached to the central region of the upper layer 38 above the bump 30 and pressure is applied during the cleaning, and the pad is wetted, the cleaning formulation is efficiently squeezed out of the central region 32.

When water or another such fluid is introduced, an aqueous dispersion of the cleaning formulation within the pad 12 is induced. In any event, the cleaning formulation, although initially located within the bump 30, is dispersed through the bottom layer 42 of the pad 12 during common use conditions (i.e., oscillation of the head 18 and introduction of water or the like).

The cleaning formulation itself may be any of a number of different formulations. The cleaning formulation is preferably optimized for the area to be cleaned (e.g., kitchen, bathroom, or the like). Further, for ease of manufacture the cleaning formulation may initially have a flowable (e.g. paste-like) consistency such that the cleaning formulation is easily applied by automated equipment, and substantially retained in the bump 30 in the interior layer 40 of an unused pad, but during the use of a pad will become substantially fluid such as to disperse.

In one embodiment in which the cleaning formulation is selected for use in a kitchen the composition of the cleaning formulation may be as indicated in Table I below.

TABLE I

KITCHEN FORMULA

| Chemical Constituent | Weight Percent |
|---|---|
| C16-C18 Fatty Alcohol Ethoxylated, 80 EO surfactant | 48.5 |
| Sodium Lauryl Sulphate 90% surfactant | 35.0 |
| Sodium Polyacrylate Powder, MW 7300 | 6.0 |
| BIO-TERGE AS-90B alpha-olefinsulfonate surfactant | 4.0 |
| IFF 4919 HBD Fragrance (Fantastik) | 1.5 |
| Ethoxylate L24-4 surfactant | 5.0 |

In another embodiment in which the cleaning formulation is selected for use in a bathroom, the composition of the cleaning formulation is indicated in Table II below.

TABLE II

BATHROOM FORMULA

| Chemical Constituent | Weight Percent |
|---|---|
| Citric acid | 37.0 |
| 80 mold ethoxylate C16/C18 alcohol surfactant | 26.8 |
| Powdered sodium lauryl sulfate surfactant | 22.0 |
| Powdered alpha olefin sulfonate surfactant | 8.0 |
| 4 mole ethoxylate lauryl alcohol surfactant | 5.0 |
| Fragrance | 1.2 |

The amount of the cleaning formulation to be applied to a particular pad may vary depending on the particular size of the pad. For pad 12 it is contemplated that between 1.5 and 3.5 grams of the cleaning formulation may be initially located against the interior layer 40. For a smaller pad, such as the alternative pad 48, only a smaller amount of cleaning formulation may be necessary, for example, between 0.25 grams and 0.75 grams.

Referring now to FIG. 6, the alternative pad 48 is shown. As shown, given its smaller size, the alternative pad 48, despite comprising the same three layers of the larger pad (i.e., the upper, interior, and bottom layers), there is only a weld along the outer circumferential edge 50 and no downward projecting skirt. As the attachment surface 52 of the upper layer is smaller, the attachment surface of the motorized device 10 may also be smaller, such as is in the alternative neck 28. However, if desired pad 48 may also be provided with a bent down skirt (like skirt 34 as shown in FIG. 5 with respect to the larger version).

Referring now to FIG. 7, in this view the attachment of the attachment surface 26 of the head 18 of the motorized device 10 to the upper layer 38 of the pad 12 via a hook/loop type connection is shown. Of course, other fastening means such adhesives or mechanical connections could be used instead.

Notably, the bottom layer 42, which is an abrasive material, contacts the counter top surface 54. As the pad 12 is wetted and then oscillated by the head 18 of the motorized device 10, the cleaning fluid is dispersed down through the bottom layer 42 to the surface 54. The motion of the bottom layer 42, which has an abrasive face which contacts the surface 54, and the application of the cleaning fluid to the surface 54, assist in the cleaning of the surface 54 by chemically and mechanically removing contaminants from the surface 54.

As the central region 32 of the pad 12 provides a bulge in the form of part of the bump, this advantageously indicates that to a user that the central region 32 is an optimally balanced location at which the head 18 should be attached to the pad 12. This reduces the incidence of wobbling and splashing that might occur if the driver is not centrally positioned.

Further, as the cleaning formulation is initially located mostly in the bump 30 in the central region 32, when the user applies a pressure via the motorized device 10, the pressure is directly applied to the bump 30, which has the effect of squeezing the cleaning formulation from the central region 32 axially outward.

The weld lines, and in particular the radial weld lines 44, secure the various layers together when the pad 12 is rotationally oscillated and help to maintain the overall rigidity of the pad 12. The radial weld lines 44 prevent the layers from shearing apart when they are subjected to oscillating rotation. The problem of shearing is particularly acute when the layers have different rigidities (i.e., the interior layer is a fibrous absorbent layer) and an aqueous product is introduced.

The radial weld lines 44 also provide structural ribs which prevent the pad 12 from flapping out of plane when the pad 12 is rotationally oscillated. This reduces the radial splattering of cleaning fluid from the pad 12 as the bottom layer 42 is held in better contact with the surface 54 being cleaned. A weld line provides more rigidity for the pad 12. Mere stitching or the like would be unable to provide this as the weld is less flexible and more prone to return to its original form. Accordingly, more force would be required to bend the pad 12 such that sections would deviate from the initial plane defined by the disc.

For small pads, such as the alternative pad 48, radial weld lines may be unnecessary to maintain the integrity of the pad. The portion of the pad 48 which is secured to the attachment face of the motorized device 10 may be a sufficient percentage or all of the connection area of the pad 48 or the weld 56 about the periphery of the pad 48 may be sufficiently close to all parts of the pad 56 such that shearing of the layers is not a problem, even without radial weld lines.

Further preventing splattering the downwardly-biased outer circumferential edge 34 provides a skirt or shield around the outer periphery of the pad 12. As the outer circumferential edge 34 is a weld line, it is structurally strong and is relatively non-absorbent. Thus, most cleaning formulation and/or aqueous solution being used in the cleaning process that is about to be radially projected from the bottom layer 42 will be stopped by the outer circumferential edge 34 from splattering outside of the area immediately underneath the pad 12.

After the pad 12 has been consumed (i.e., the abrasive on the bottom layer 42 has lost its effectiveness, or the cleaning formulation has been completely consumed, or the like), the user may remove the pad 12 by pinching a tab 36 and yanking to remove the pad 12 from the motorized device 10. In this way, the user can avoid touching areas of the pad 12 which may be covered by the formulation.

The welds can be created by ultrasonic or other thermal-based welding, and the skirt can be created by edge heat molding. Thus, a multi-layer surface treatment pad and driver device for use therewith are disclosed that allow for the efficient scrubbing of a dirty surface (or other surface treatment) without splattering the formulation or too quickly degrading the pad. As well as providing a longer lasting pad of a type that can deliver the surface treating formulation, the structure provides a clear indication to a user of where the attachment head of the motorized device should be optimally attached to the pad. Further, given that the attachment head is attached over a bump of the formulation, pressure applied by the user will advantageously help disperse the formulation.

While preferred embodiments of the present invention have been described above, it should be appreciated that the invention could be used in a variety of other embodiments. For example, the motorized device 10 need not necessarily apply oscillatory rotary motion. It could instead provide non-oscillatory rotary motion of the pad, or even back and forth axial motion. Furthermore, the formulations used in the pads could have different quantities of the listed constituents, have additional constituents, or have some constituents removed. For example a furniture polisher would have pads which use chemicals more appropriate with a wood surface.

Also while the surface to be treated will most often be a hard surface (e.g. bathroom tile; a counter top; a window), these devices may also be used with a softer surface such as a fabric having a spot remover to be worked in.

Additionally, the pad may include more than three layers, or just two layers, and the layers may be made of varied materials.

Such other modifications may be made without departing from the spirit and scope of the invention. Thus, the claims (rather than just the preferred embodiments) should be reviewed in order to understand the full scope of the invention.

INDUSTRIAL APPLICABILITY

Disclosed are improved surface treating pads for use with rotational (e.g. oscillatory) devices.

What is claimed is:

1. A cleaning device for cleaning a surface comprising:

a motorized driver having a head that rotates, the head having a face presenting a part of a fastening system; and a multi-layer surface treating pad, comprising:

an upper layer suitable to serve as another part of the fastening system so as to be mountable against said face and rotated thereby;

a bottom layer suitable to be placed on the surface which comprises an abrasive material; and a cleaning formulation that has been positioned between the upper and bottom layer before the pad is used for cleaning;

wherein the bottom layer is configured to inhibit liquid from splattering outside an area immediately underneath the pad if the pad is rotated when the pad is positioned on the surface to be cleaned.

2. The cleaning device of claim 1, wherein the fastening system is a hook/loop type fastening system.

3. A cleaning device comprising:

a motorized driver having a head that rotates, the head having a face presenting a part of a fastening system; and a multi-layer surface treating pad, comprising:

an upper layer suitable to serve as another part of the fastening system so as to be mountable against said face and rotated thereby;

a bottom layer which comprises an abrasive material; and a cleaning formulation that has been positioned between the upper and bottom layer before the pad is used for cleaning;

wherein an outer circumferential edge of the pad extends downwardly in a form of a skirt to create a cup-shaped contact area that is capable of inhibiting liquid from splattering outside an area immediately underneath the pad if the pad is rotated.

4. The cleaning device of claim 3, wherein the cleaning formulation is in the form of a bump and the bump of the formulation causes the upper layer to bulge upwardly so as to provide a visual indication as to where one might attach the motorized driver thereto.

5. The cleaning device of claim 3, wherein the upper and bottom layers are welded together both around a central region of the pad and around a circumferential periphery of the pad.

6. The cleaning device of claim 3, wherein the formulation is in the form of a flowable material selected from the group consisting of pastes and gels.

7. A cleaning device comprising:

a motorized driver having a head that rotates, the head having a face presenting a part of a fastening system; and a multi-layer surface treating pad, comprising:

an upper layer suitable to serve as another part of the fastening system so as to be mountable against said face and rotated thereby;

a bottom layer which comprises an abrasive material; and a cleaning formulation that has been positioned between the upper and bottom layer before the pad is used for cleaning;

wherein the upper and bottom layers are welded together; and wherein the upper and bottom layers are welded together with an array of weld spokes radiating outwardly from a central region of the pad.

* * * * *